US007719495B2

(12) United States Patent
Lee et al.

(10) Patent No.: US 7,719,495 B2
(45) Date of Patent: May 18, 2010

(54) ORGANIC LIGHT EMITTING DIODE DISPLAY DEVICE AND DRIVING METHOD THEREOF

(75) Inventors: Jae Sung Lee, Suwon-si (KR); Chang Hoon Lee, Suwon-si (KR)

(73) Assignee: Samsung Mobile Display Co., Ltd., Yongin, Gyunggi-do (KR)

( * ) Notice: Subject to any disclaimer, the term of this patent is extended or adjusted under 35 U.S.C. 154(b) by 717 days.

(21) Appl. No.: 11/699,609

(22) Filed: Jan. 29, 2007

(65) Prior Publication Data

US 2007/0285360 A1 Dec. 13, 2007

(30) Foreign Application Priority Data

Jun. 8, 2006 (KR) ..... 10-2006-0051579

(51) Int. Cl.
*G09G 3/30* (2006.01)
*G09G 3/32* (2006.01)
*G09G 5/10* (2006.01)

(52) U.S. Cl. ..... 345/77; 345/82; 345/690

(58) Field of Classification Search ..... 345/77, 345/82, 690

See application file for complete search history.

(56) References Cited

U.S. PATENT DOCUMENTS

2003/0025718 A1* 2/2003 Mori ..... 345/690

FOREIGN PATENT DOCUMENTS

| | | | |
|---|---|---|---|
| JP | 2002-132218 | | 5/2002 |
| JP | 2002-351402 | | 12/2002 |
| JP | 2007298778 | A * | 11/2007 |
| KR | 10-2005-0085309 | A | 8/2005 |

* cited by examiner

*Primary Examiner*—Richard Hjerpe
*Assistant Examiner*—Sahlu Okebato
(74) *Attorney, Agent, or Firm*—Knobbe Martens Olson & Bear LLP

(57) ABSTRACT

An organic light emitting diode display device capable of reducing power consumption by limiting a current to lower the total luminance if an area exhibiting a high luminance is larger than a threshold, and a driving method thereof are disclosed. The device includes a luminance controller for controlling an emission time of the pixel unit by determining a luminance limit of the pixel unit corresponding to a sum of the values of the video data input into one frame; and a power source controller for controlling driving of the luminance controller to correspond to the luminance limit of the pixel unit.

9 Claims, 7 Drawing Sheets

ORGANIC LIGHT EMITTING DIODE DISPLAY DEVICE AND DRIVING METHOD THEREOF

CROSS-REFERENCE TO RELATED APPLICATIONS

This application claims the benefit of Korean Patent Application No. 2006-0051579, filed on Jun. 8, 2006, in the Korean Intellectual Property Office, the disclosure of which is incorporated herein by reference.

BACKGROUND OF THE INVENTION

1. Field of the Invention

The field relates to an organic light emitting diode display device and a driving method thereof, and more particularly to an organic light emitting diode display device with luminance being limited depending on a luminous area and in which the luminance is varied depending on the luminous area, and a driving method thereof.

2. Description of the Related Technology

In recent years, there have been developed various flat panel displays which are more lightweight and have a smaller volume than a cathode ray tube. At this time, the flat panel displays includes a display region in which a plurality of pixels are arranged in a matrix form on a substrate, and an image is displayed by connecting scan lines and data lines to each of the pixels to selectively apply a data signal to the pixels.

Flat panel displays are classified into a passive matrix type display device and an active matrix type display device, depending on driving systems of pixels, and the active matrix type display device which selectively turns on the light in every unit pixel has been widely used because of aspects of resolution, contrast, response time.

Flat panel displays have been used as displays or monitors of information appliances, such as personal computers, mobile phones, PDA, etc., and LCD using a liquid crystal panel, an organic light emitting diode display device using an organic light emitting diode, PDP using a plasma panel and the like are widely known among flat panel displays, an organic light emitting display device is recognized for having excellent luminous efficiency, luminance and viewing angle and a rapid response time.

SUMMARY OF CERTAIN INVENTIVE ASPECTS

Some aspects provide an organic light emitting diode display device capable of reducing a power consumption and improving quality of images since a current is limited to lower the total luminance if an area for exhibiting a high luminance is large relative to the entire display area, and a driving method thereof.

One aspect is an organic light emitting diode display device including a pixel unit including a plurality of pixels configured to receive a plurality of scan signals, a plurality of light emission control signals and a plurality of data signals to display an image, a scan driver configured to transmit the scan signals and the light emission control signals to the pixel unit, a data driver configured to generated a plurality of data signals including video data and to transmit the generated data signals to the pixel unit, a luminance controller configured to control an emission time of the pixel unit by determining a luminance limit of the pixel unit, the luminance limit corresponding to the sum of the values of the video data of a frame, and a power source controller configured to control the driving of the luminance controller according to the luminance limit of the pixel unit.

Another aspect is a method of driving an organic light emitting diode display device including pixels, the method including calculating the sum of values of a data signal input during one frame period, and determining a luminance limit corresponding to the sum, and selectively applying the luminance limit by limiting a current to the pixels if the sum is greater than a predetermined value.

Another aspect is an organic light emitting diode display device, including a luminance controller configured to control an emission of the device, where the luminance controller is configured to reduce the emission if the video data indicates that a portion of the display device greater than a threshold is to emit light with a luminance over a limit.

BRIEF DESCRIPTION OF THE DRAWINGS

These and/or other aspects and advantages will become apparent and more readily appreciated from the following description, taken in conjunction with the accompanying drawings of which.

DETAILED DESCRIPTION OF CERTAIN INVENTIVE EMBODIMENTS

Hereinafter, certain embodiments will be described with reference to the accompanying drawings. Here, when one element is connected to another element, one element may be not only directly connected to the other element but may be indirectly connected to the other element via a third element. Further, in some cases irrelative elements are omitted for clarity.

Figure 1:
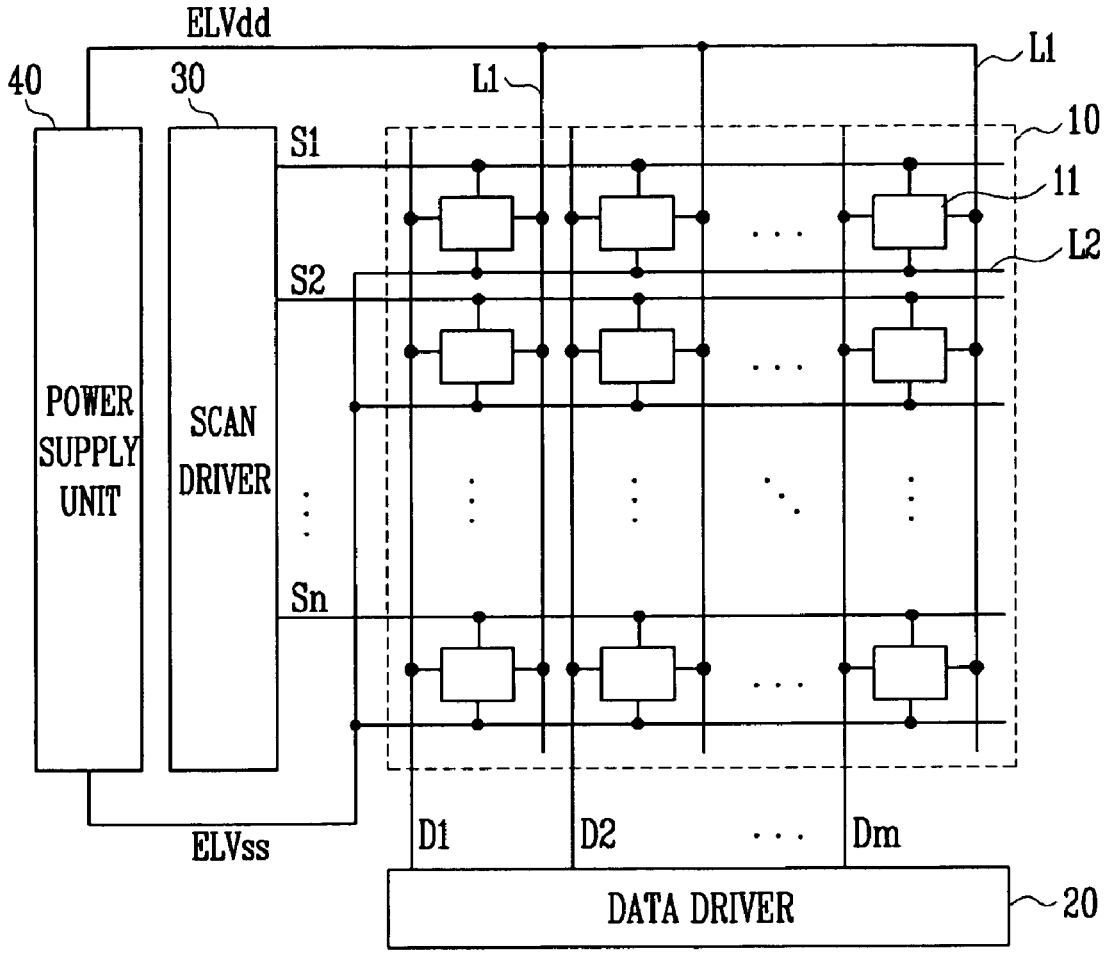
FIG. 1 is a cross-sectional view showing a conventional organic light emitting diode display device.

FIG. 1 is a schematic view showing a conventional organic light emitting diode display device. Referring to FIG. 1, the organic light emitting diode display device includes a pixel unit 10, a data driver 20, a scan driver 30 and a power supply unit 40.

The pixel unit 10 has a plurality of pixels 11 arranged therein, and organic light emitting diodes (not shown) are connected to each of the pixels 11. The "n" number of scan lines (S1, S2, . . . Sn−1, Sn) formed in a horizontal direction transmit a scan signal; the "m" number of data lines (D1, D2, . . . Dm−1, Dm) formed in a vertical direction transmit a data signal; the "m" number of first power supply lines (not shown) transmit a first power source; and the "m" number of second power supply lines (not shown) transmit a second power source (ELVss) having a lower electric potential than that of the first power source (ELVdd), and are formed on pixel unit 10. The pixel unit 10 displays an image by allowing the luminous elements to emit the lights by means of the scan signal, the data signal, the first power source (ELVdd) and the second power source (ELVss).

The data driver 20 is a unit configured to apply a data signal to the pixel unit 10 by driving the data lines (D1, D2 . . . Dm−1, Dm).

The scan driver 30 is a unit configured to sequentially output a scan signal and is connected to the scan lines (S1, S2, . . . Sn−1, Sn) to supply the scan signal to a specific row of the pixel unit 10. The data signal input in the data driver 20 is applied to the specific row of the pixel unit 10 to which the scan signal are supplied to display an image, and one frame is completed when all rows have been sequentially selected.

The power supply unit 40 transmits a first power level (ELVdd) and a second power level (ELVss) to the pixel unit 10, the second power level (ELVss) having a lower electric potential than the first power level (ELVdd), and therefore an electric current corresponding to the data signal is allowed to flow in each of the pixels 11 due to a voltage difference of the first power level (ELVdd) and the second power level (ELVss).

In the organic light emitting diode display device as configured above, a large electric current flows to the pixel unit 10 if it is to emit with a high luminance, and a small electric current flows to the pixel unit 10 if it is to emit with a low luminance. Accordingly, if a large electric current flows to the pixel unit 10 to exhibit a high luminance, then the power supply unit 40 supplies a high power since a large current load is applied to the power supply unit 40.

Also, contrast may be diminished by, for example, glare, if there are many regions exhibiting a high luminance, resulting in a reduced quality of images.

Figure 2:
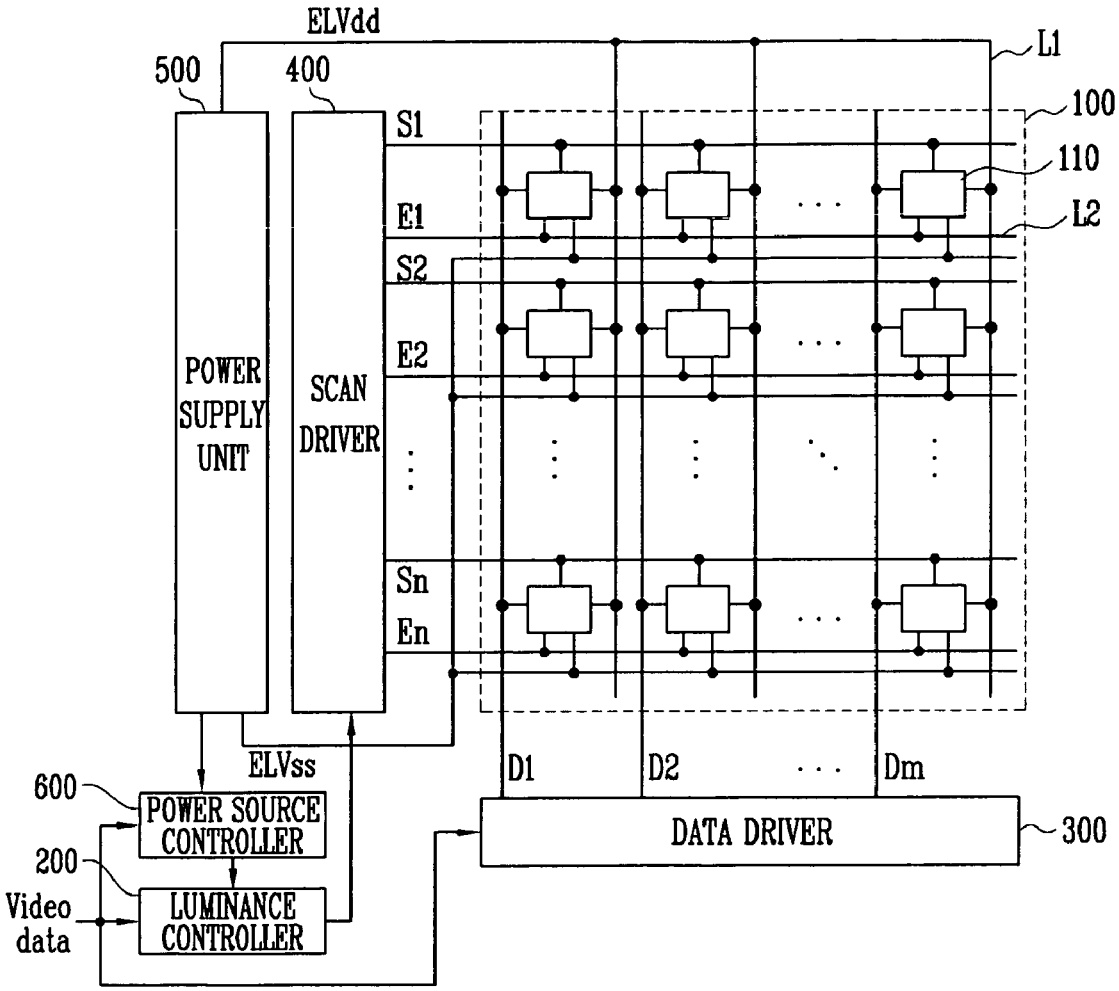
FIG. 2 is a cross-sectional view showing an organic light emitting diode display device.

FIG. 2 is a cross-sectional view showing an organic light emitting diode display device according to some embodiments. Referring to FIG. 2, the light emitting display device includes a pixel unit 100, a luminance controller 200, a data driver 300, a scan driver 400, a power supply unit 500 and a power source controller 600.

The pixel unit 100 has a plurality of pixels 110 arranged therein, and organic light emitting diodes (not shown) are connected to each of the pixels 110. The "n" number of scan lines (S1, S2, . . . Sn−1, Sn) formed in a horizontal direction and transmit a scan signal. The "n" number of light emission control signal lines (E1, E2, . . . En−1, En) transmit a light emission control signal. The "m" number of data lines (D1, D2 . . . Dm−1, Dm) formed in a vertical direction transmit a data signal. Another embodiment is a first power line (L1) transmits a first power level (ELVdd) to pixels, and a second power line (L2) transmits a second power level (ELVss) to pixels. The second power line (L2) may be electrically connected to each of the pixels 110 since it may be equivalently placed and formed over the pixel unit 100.

The luminance controller 200 limits luminance by outputting a luminance control signal so that luminance of the pixel unit 100 to display an image cannot exceed a threshold level. The luminance of the pixel unit 100 is higher when an area for emitting the light with a high luminance is large in the pixel unit 100 compared to when the area for emitting light with a high luminance is small. For example, the pixel unit 100 has a higher luminance when it emits light with a full white color than when it does not emit light with a full white color. Accordingly, if image data indicates that the area for emitting the light with a high luminance is large as described above, luminance controller 200 can limit the luminance to a certain level. Accordingly, the luminance limit is varied depending on the area emitting the light with a high luminance according to the data, and therefore luminance is allowed to be varied depending on the area emitting the light with a high luminance.

The luminance controller 200 determines size of the frame data based on the sum of the components of the video data signal input into one frame, and then determines that a current, which flows to the pixel unit 100 emitting the light brightly, is large if the size of the frame data is large, and determines that a current which flows to the pixel unit 100 is small if the size of the frame data is small. Accordingly, the luminance controller 200 outputs a luminance control signal for limiting a luminance if the size of the frame data signal exceeds a threshold, and therefore the entire brightness of the images expressed in the pixel unit 100 is reduced to display the images.

If the brightness of the pixel unit 100 is limited by the luminance controller 200, then the current flowing to the pixel unit 100 is limited, and therefore the pixel unit 100 does not require the power supply unit 500 to output a high power. And, if the luminance of the pixel unit 100 is not limited, then its luminance is enhanced since an emission time of the emitting pixels is maintained for an extended time, resulting in an enhanced contrast ratio of the emitting pixels and the non-emitting pixels. Accordingly, the contrast ratio of the pixel unit 100 is improved.

At this time, if the emission time of the pixels is decreased to reduce current flowing to the pixel unit 100, then the current flowing to the pixel unit 100 may be reduced since a supply time of the electric current is reduced.

In order to control an emission time of the pixel unit 100, the luminance controller 200 controls the emission time when the pixel unit 100 emits light in one frame by controlling a pulse width of the light emission control signal transmitted through the light emission control signal lines (E1, E2, . . . En−1, En). As a result, the current flowing into the pixel unit 100 increases if the light emission control signal has a long pulse width. Therefore, the total luminance is not reduced in the pixel unit 100, while an electric current capacity flowing into the pixel unit 100 decreases if the light emission control signal has a short pulse width, and therefore the total luminance is reduced in the pixel unit 100.

The data driver 300 is configured to apply a data signal to the pixel unit 100, and receives a video data having red, blue and green elements to generate a data signal. And, the data driver 300 is connected to the data lines (D1, D2 . . . Dm−1, Dm) of the pixel unit 100 to apply the generated data signal to the pixel unit 100.

The scan driver 400 is configured to apply a scan signal and a light emission control signal to the pixel unit 100, and the scan driver 400 is connected to the scan lines (S1, S2, . . . Sn−1, Sn) and the light emission signal lines (E1, E2, . . . En−1, En) to transmit the scan signal and the light emission control signal to rows of the pixel unit 100. The data signal outputted from the data driver 300 is transmitted to the pixel 110 to which the scan signal is transmitted, and the pixel 110 to which the light emission control signal is transmitted emits the light depending on the light emission control signal.

The scan driver 400 is divided into two groups: a scan driving circuit for generating a scan signal; and a light emission driving circuit for generating a light emission control signal. Here, the scan driving circuit and the light emission driving circuit may be included in one circuit, or present as separate circuits.

The data signal input in the data driver 300 is applied to a certain row of the pixel unit 100 to which the scan signal is transmitted, and an electric current corresponding to the data signal is transmitted to the luminous elements to display an image by allowing the luminous elements to emit light. One frame is completed once all rows are sequentially selected.

The power supply unit 500 transmits the first power level (ELVdd) and the second power level (ELVss) to the pixel unit 400, which allows an electric current, corresponding to the data signal, to flow in each of the pixels due to a difference between the first power level (ELVdd) and the second power level (ELVss).

The power source controller 600 drives the luminance controller 200 to limit the luminance, while the luminance controller 200 is not driven in order not to limit a luminance, and therefore power consumption may be reduced by the luminance controller 200. The power source controller 600 controls the driving of the luminance controller 200 to correspond to the sum of the data signal values input during one frame period. The luminance limit in the luminance controller 200 is large if the sum of the data signal input during one frame period is limited in a large range, but small if the sum of the data signal inputted during one frame period is limited in a small range. Accordingly, if the sum of the data signal is decreased to at least a certain value, then deterioration of the brightness should be prevented to inhibit generation of an overly-limited luminance width. Additionally, if the driving of the luminance controller 200 is stopped when the luminance limit is not generated, then the power consumption in the luminance controller 200 may be reduced, and therefore the power source controller 600 determines driving of the luminance controller 200 by determining whether the luminance limit is generated by means of the sum of the values of the data signal.

Figure 3:
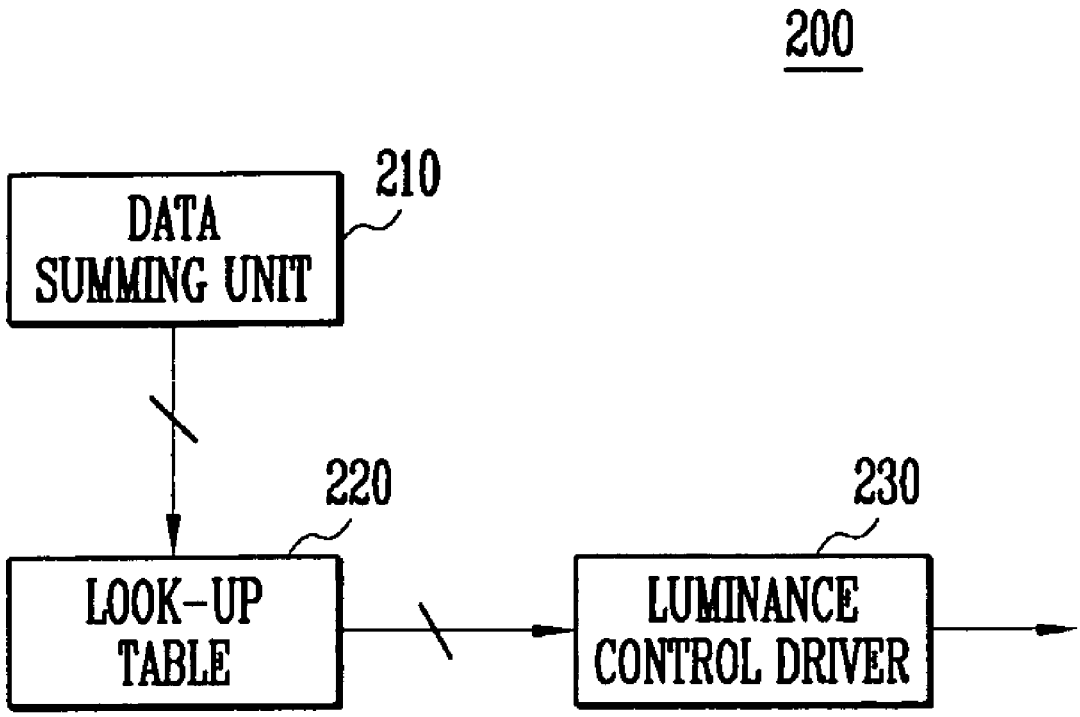
FIG. 3 is a cross-sectional view showing one embodiment of a luminance controller used for the organic light emitting diode display device.

FIG. 3 is block diagram showing one embodiment of a luminance controller used for the organic light emitting diode display device. Referring to FIG. 3, the luminance controller 200 includes a data summing unit 210, a look-up table 220 and a luminance control driver 230.

The data summing unit 210 extracts information about frame data and sums up video data having information about red, blue and green colors input into one frame. Since the frame data sums up all video data ozone frame, the luminance of the display can be modified such that if the video data has a large amount of data, a high luminance is used, and if the video data has a small amount of data, a low luminance is used.

The look-up table 220 assigns a width of a light emission period for the light emission control signal depending on the data value of the frame data. Upper bits of the frame data may be used to assign a width of the light emission period. For example, the upper 5 bits of the frame data may be used to determine a brightness level of the pixel unit 100 in one frame.

Accordingly, the luminance of the pixel unit 100 increases as the size of the frame data increases, and the luminance of the pixel unit 100 is limited if the brightness exceeds a predetermined brightness. Also, the luminance of the pixel unit 100 may be prevented from being enhanced beyond a limit since the luminance of the pixel unit 100 is limited increasingly as the luminance of the pixel unit 100 increases.

If the luminance of the pixel unit 100 is limited uniformly as the luminance of the pixel unit 100 increases, a very bright picture is provided when the pixel unit 100 displays a very high luminance since the luminance is excessively limited by the luminance limit, indicating that the overall brightness is simply reduced. Accordingly, the luminance of the pixel unit 100 is prevented from falling below a minimum luminance limit by assigning the luminance limit to the pixel unit 100 if the entire pixel unit 100 expresses a white color by setting the luminance to the maximum limit.

And, the luminance is set not to be limited if the size of the frame data does not exceed a certain size, and therefore the luminance is set not to be limited if the luminance is not high.

Table 1 lists one example of a look-up table, where a light emission ratio is limited to a range of 50% of the maximum value depending on the number of the pixels emitting the light with a luminance over the luminance limit.

TABLE 1

| Upper 5 bit value | Light emission rate | Light emission ratio | Luminance | Width of Light emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | — | — | — | — |
| 29 | — | — | — | — |
| 30 | — | — | — | — |
| 31 | — | — | — | — |

In this example, since the luminance is not limited if the portion of the luminous area emitting the light with the maximum luminance is less than 36%, and the luminance is limited if the portion of the luminous area emitting the light with the maximum luminance exceeds 36%, a limitation ratio of the luminance is also increased if the area emitting the light with the maximum luminance increases. And, since the maximum limitation ratio of the luminance is set to 50% to prevent the luminance from being limited excessively, the limitation ratio of the luminance is not lowered to a range of 50% or less even though the most pixels of the pixel unit 100 emit the light with the maximum luminance.

Table 2 lists another example of a look-up table, and the light emission to a range of 33% of the maximum value depending on the number of the light with a luminance over the limit.

TABLE 2

| Upper 5 bit value | Light emission rate | Light emission ratio | Luminance | Width of Light emission control signal |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |

TABLE 2-continued

| Upper 5 bit value | Light emission rate | Light emission ratio | Luminance | Width of Light emission control signal |
|---|---|---|---|---|
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | — | — | — | — |
| 29 | — | — | — | — |
| 30 | — | — | — | — |
| 31 | — | — | — | — |

In this example, since the luminance is not limited if the portion of the luminous area emitting light with the maximum luminance is less than 34%, and the luminance is limited if the portion of the luminous area emitting light with the maximum luminance exceeds 34%, a limitation ratio of the luminance is also increased if the area emitting light with the maximum luminance increases. And, since the maximum limitation ratio of the luminance is set to 33% to prevent the luminance from being limited excessively, the limitation ratio of the luminance is not lowered to a range of 33% or less even though the most pixels of the pixel unit 100 emit light with the maximum luminance.

In some embodiments, the luminance control driver 230 receives an upper 5-bit value to output a luminance control signal. The light emission control signal is output to the scan driver 400 depending on the luminance control signal so that the luminance control signal controls the scan driver 400. In particular, if the scan driver 400 is divided into a scan driving circuit and a light emission control circuit, then the light emission control signal is output depending on the luminance control signal since the luminance control signal is input to the light emission control circuit.

In some embodiments, the maximum light emission period of the light emission control signal is set to 325 periods. Accordingly, 8 bits can express 256 values and 9 bits can express 512 values, and therefore the luminance control signal preferably outputs a 9-bit signal to generate a light emission period of the light emission control signal, as listed in Table 1. The luminance control signal may use a start pulse, and the width of the light emission control signal may be determined by the width of the start pulse.

Figure 4A:
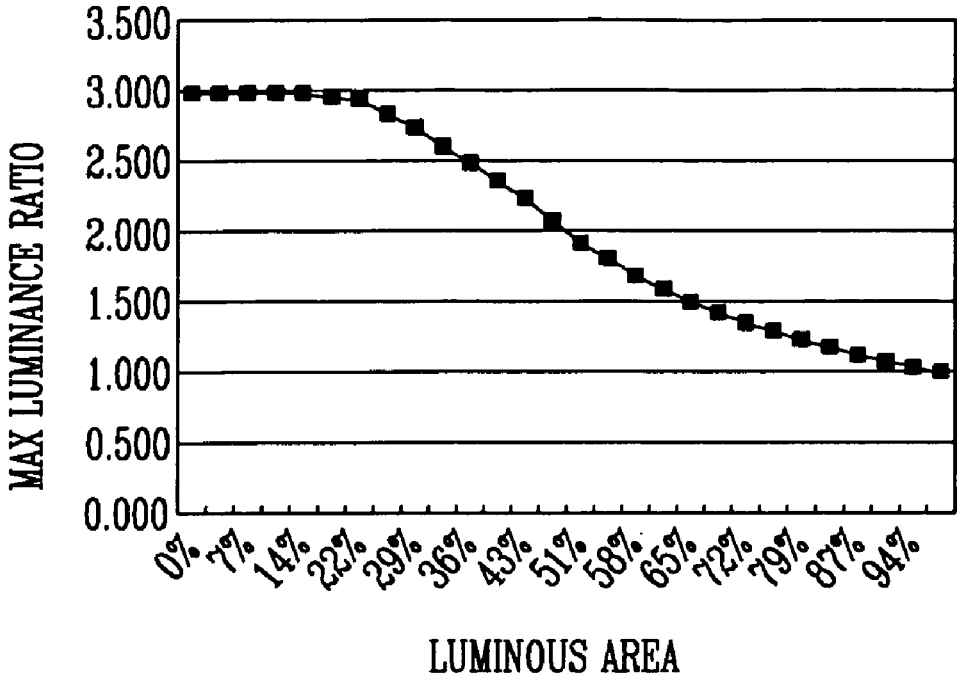
FIG. 4*a* through FIG. 4*d* are diagrams showing that current is limited to 33% of the maximum of the organic light emitting diode display device.
Figure 4B:
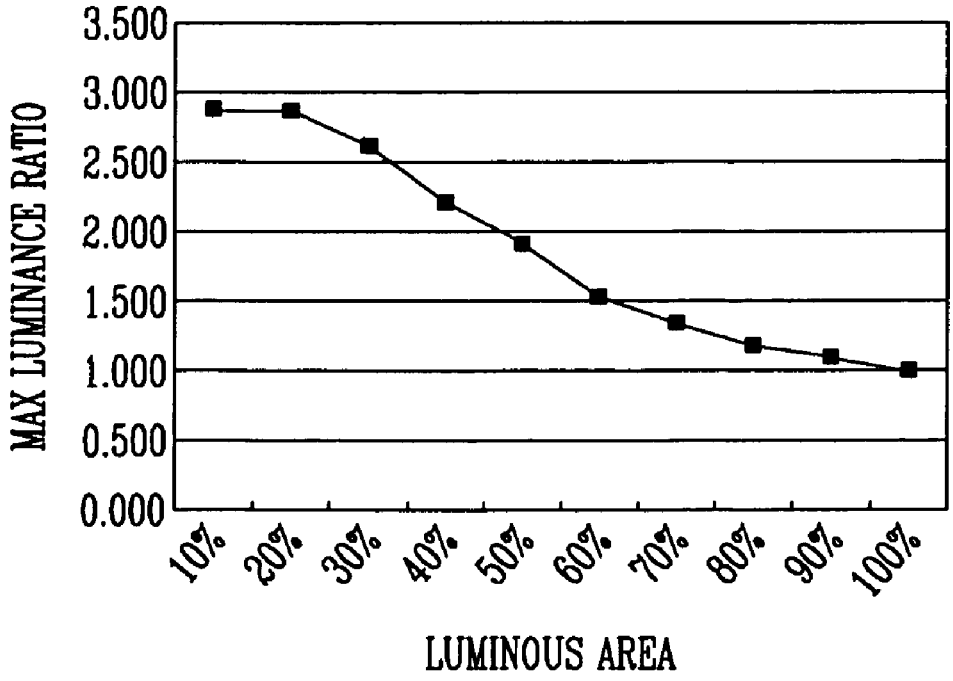
Figure 4C:
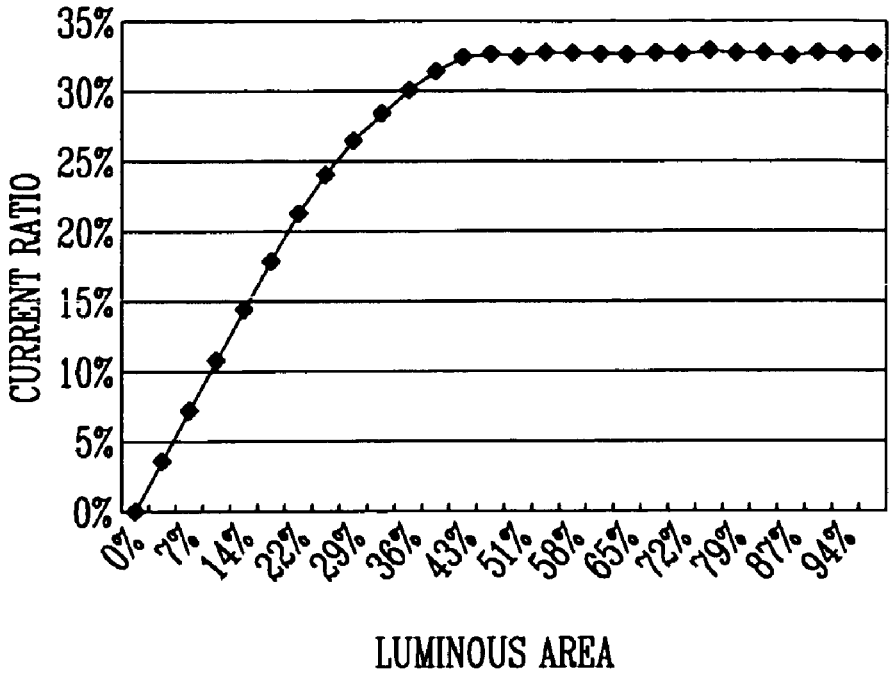
Figure 4D:
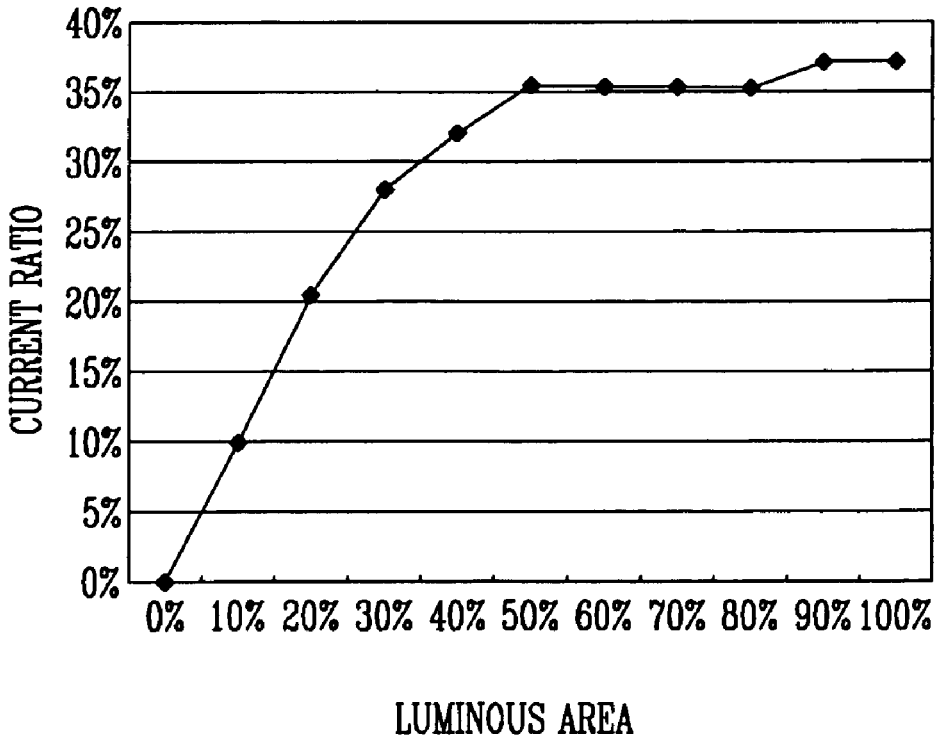

FIG. 4*a* through FIG. 4*d* are diagrams showing that the light emission ratio of the light emission control signal is limited to 33% of the maximum electric current capacity. FIG. 4*a* shows a relation between a luminous area and a luminance ratio which are calculated mathematically, and FIG. 4*b* shows a relation between a luminous area and a luminance ratio which are actually measured. And, FIG. 4*c* shows a relation between a luminous area and a luminance ratio which are calculated mathematically, and FIG. 4*d* shows a relation between a luminous area and a luminance ratio which are actually measured.

Referring to FIG. 4*a* and FIG. 4*b*, a picture is not darkened since the luminance is maintained to a constant level if an area occupied by pixels emitting light with a luminance over a limit is less than about 30%. Also, the luminance is gradually reduced to prevent glares by preventing a picture from being displayed at an excessively bright level if an area occupied by pixels emitting light with a luminance over a limit is in a range of about 30%.

Referring to FIG. 4*c* and FIG. 4*d*, the power supply unit 500 does not need to source a high power since a load applied to the power supply unit 500 is decreased if the current under the brightness limit ranges from approximately 30% to approximately 35% of the current capacity flowing without the brightness limit.

Figure 5A:
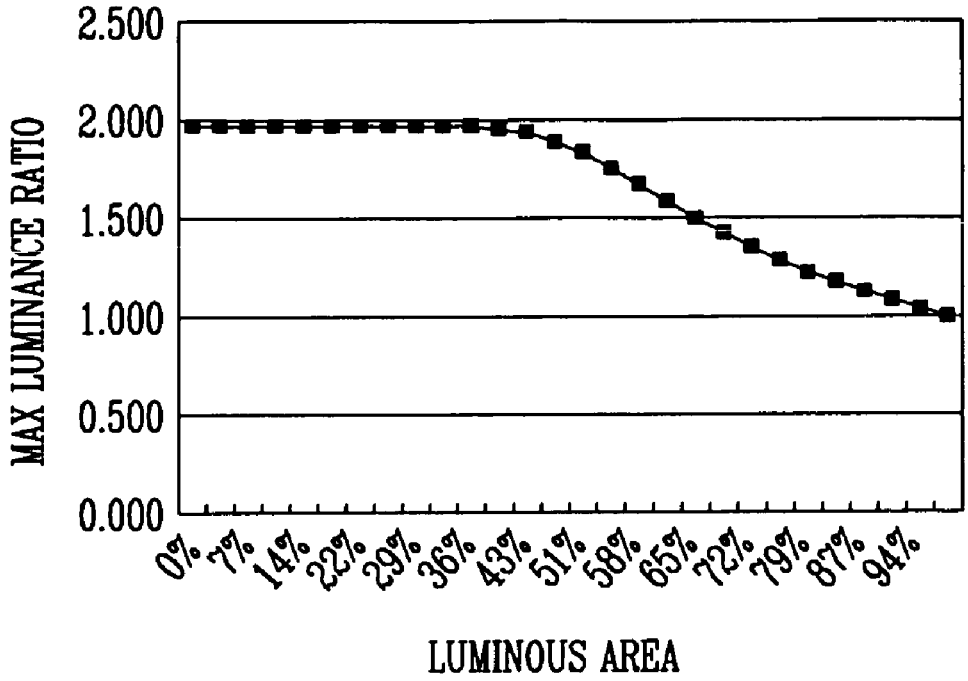
FIG. 5*a* through FIG. 5*d* are diagrams showing that current is limited to 33% of the maximum of the organic light emitting diode display device.
Figure 5B:
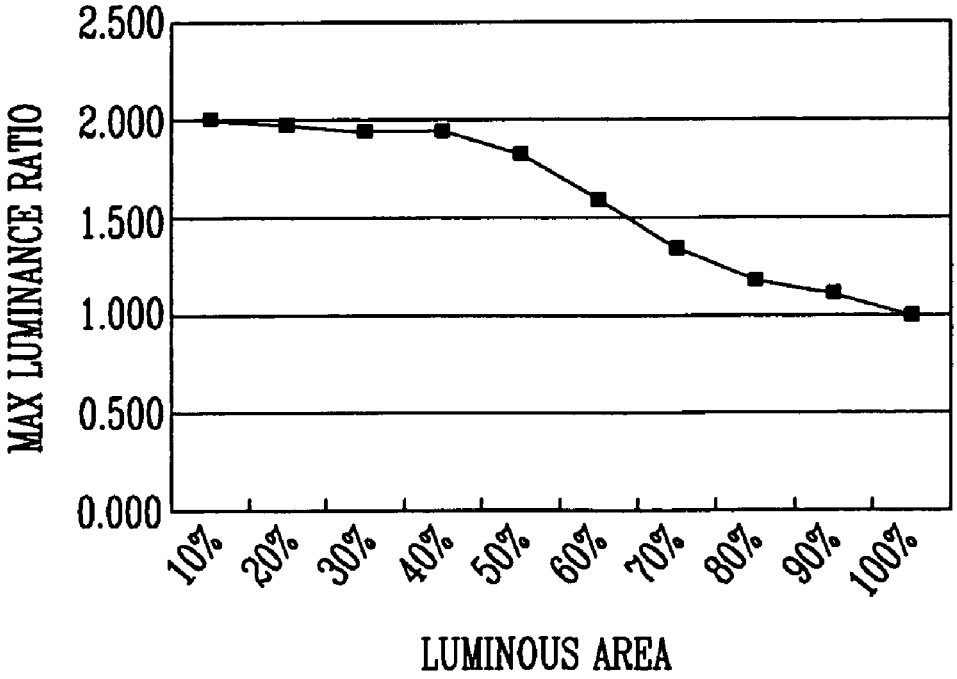
Figure 5C:
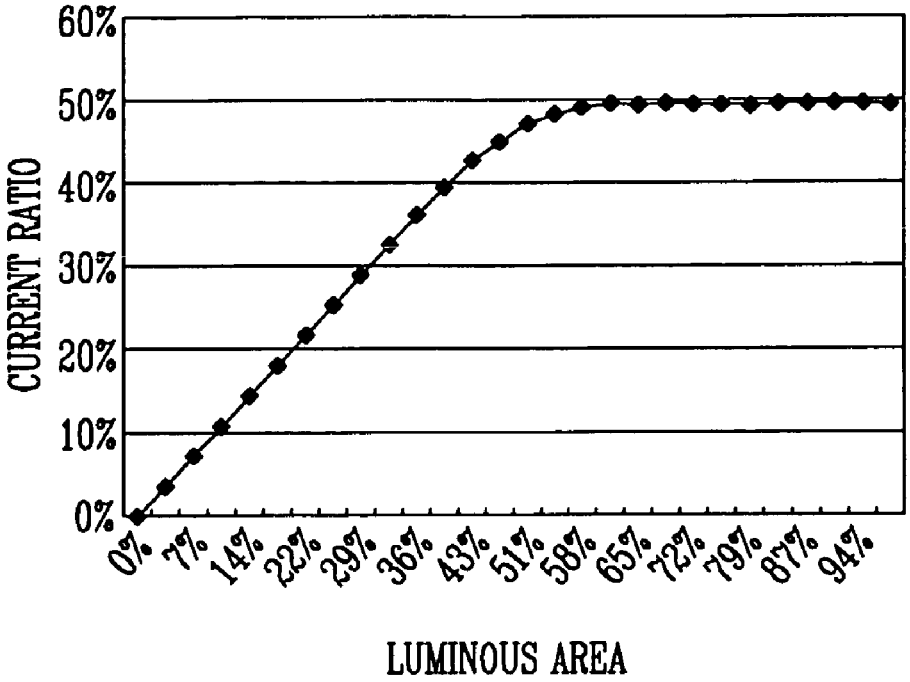
Figure 5D:
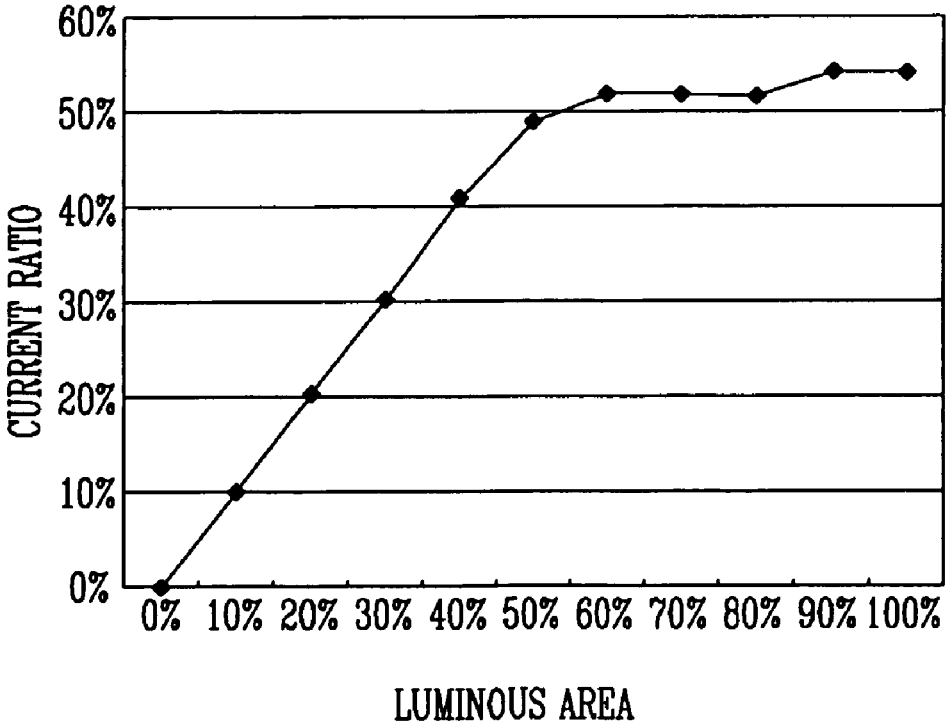

FIG. 5*a* through FIG. 5*d* are diagrams showing that the light emission ratio of the light emission control signal is limited to about 50% of the maximum electric current. FIG. 5*a* shows the relation between the luminous area and the luminance ratio which are calculated mathematically, and FIG. 5*b* shows the relation between the luminous area and the luminance ratio which are actually measured. And, FIG. 5*c* shows the relation between the luminous area and the luminance ratio which are calculated mathematically, and FIG. 5*d* shows the relation between the luminous area and the luminance ratio which are actually measured.

Referring to FIG. 5*a* and FIG. 5*b*, the luminance is maintained at a constant level if the area occupied by pixels emitting light with a luminance over a limit is less than about 40%, and the luminance is gradually diminished to prevent glares by preventing a picture from being displayed at an excessively bright level if an area occupied by pixels emitting light with a luminance over a limit is in a range of about 40% or more.

Referring to FIG. 5*c* and FIG. 5*d*, the power supply unit 500 does not source a high power since the load applied to the power supply unit 500 is decreased if the current under the brightness limit is in range of approximately 50% of the current capacity flowing without the brightness limit.

The organic light emitting diode display device and the driving method thereof may reduce power consumption and improve quality of images by limiting luminance time of the organic light emitting diode display device to correspond to a data signal input during one frame and thereby limiting current corresponding to the limited luminance time. The device also does not, therefore, need a high-power power supply unit. Also, power consumption may be reduced by controlling driving of the driver, which serves to determine a limited luminance width.

The embodiments described above are examples for the purpose of illustration only, and are not intended to limit the scope of the invention, so it should be understood that other equivalents and modifications could be made thereto without departing from the spirit and scope of the invention as apparent to those skilled in the art.

What is claimed is:

1. An organic light emitting diode display device comprising:

a pixel unit comprising a plurality of pixels configured to receive a plurality of scan signals, a plurality of light emission control signals and a plurality of data signals to display an image;

a scan driver configured to transmit the scan signals and the light emission control signals to the pixel unit;

a data driver configured to generate a plurality of data signals comprising video data and to transmit the generated data signals to the pixel unit;

a luminance controller configured to control an emission time of the pixel unit by determining a luminance limit of the pixel unit, the luminance limit corresponding to the sum of the values of the video data of a frame; and a power source controller configured to control the driving of the luminance controller according to the luminance limit of the pixel unit.

2. The organic light emitting diode display device according to claim 1, wherein the emission time of the pixel unit is controlled depending on the size of frame data.

3. The organic light emitting diode display device according to claim 1, wherein the power source controller is configured to determine the luminance limit depending on a size of frame data.

4. The organic light emitting diode display device according to claim 1, wherein the scan driver is divided into a scan driving circuit configured to transmit the scan signal and a light emission control driving circuit configured to transmit the light emission control signal, wherein a luminance control signal controls the light emission control driving circuit.

5. The organic light emitting diode display device according to claim 1, wherein the luminance controller comprises:

a data summing unit configured to sum values of a data signal input during one frame period;

a look-up table configured to store the luminance limit corresponding to the summed value of the data signal; and a luminance controller configured to receive the luminance limit from the look-up table.

6. The organic light emitting diode display device according to claim 5, wherein a pulse width of the plurality of light emission control signals is controlled by the luminance controller.

7. The organic light emitting diode display device according to claim 1, further comprising a power supply unit configured to supply power to the pixel unit.

8. The organic light emitting diode display device according to claim 7, wherein the power supply unit is configured to interrupt a driving power source to be transmitted into the luminance controller if the sum of the data signal values is less than a selected value.

9. The organic light emitting diode display device according to claim 8, wherein the sum of the data signal values is less than a selected value due to the operation of the controller.

* * * * *